US005112014A

United States Patent [19]

Nichols

[11] Patent Number: 5,112,014

[45] Date of Patent: May 12, 1992

[54] PEG BOARD HANGERS AND RETAINERS

[76] Inventor: Byron Nichols, 95 Tonnancour, Grosse Pointe Farms, Mich. 48236

[21] Appl. No.: 347,198

[22] Filed: May 4, 1989

[51] Int. Cl.[5] ..... F16M 13/00

[52] U.S. Cl. ..... 248/220.3; 248/222.1; 248/221.2; 248/221.2

[58] Field of Search ..... 248/220.3, 220.4, 222.1, 248/221.2, 74.3, 221.1, 505, 500; 211/70.6, 57.1, 59.1; 24/458, 485, 265 AL, 16 PB, 17 AP

[56] References Cited

U.S. PATENT DOCUMENTS

| | | | |
|---|---|---|---|
| 3,850,396 | 11/1974 | Orlandi | 248/221.1 |
| 4,029,281 | 6/1977 | Marshall | 248/220.3 |
| 4,143,772 | 3/1979 | Bona | 211/59.1 |
| 4,557,456 | 12/1985 | Mueller | 248/220.3 X |
| 4,714,221 | 12/1987 | Cawrey | 248/220.3 X |
| 4,766,651 | 8/1988 | Kobayashi et al. | 248/74.3 X |

FOREIGN PATENT DOCUMENTS

| | | | |
|---|---|---|---|
| 2838962 | 3/1980 | Fed. Rep. of Germany | 248/222.1 |
| 1005269 | 9/1963 | United Kingdom | 24/16 PB |
| 2096886 | 10/1982 | United Kingdom | 211/60 T |

*Primary Examiner*—Karen J. Chotkowski

*Attorney, Agent, or Firm*—Barnes, Kisselle, Raisch, Choate, Whittemore & Hulbert

[57] ABSTRACT

A retainer for holding a peg board hook against the front surface of the board. The retainer has a variable length strap for at least partially encircling the shank of a peg board-mounted hook in restraining relation thereto, and a head or body with a prong removably insertable in a selected hole of the peg board in the vicinity of mounted peg board hook. The prong has a tang for engaging the rear surface of the peg board. The strap is tensionable for increasing the grip of the retainer on the shank of the associated peg board hook to be retained. In one form the retainer is molded in one piece from plastic material and has a head with a through-passageway with a resilient locking tang operably disposed therein. The strap is a long, narrow flexible member affixed at one end to the head to extend therefrom to a free end. The strap has teeth formed thereon and is dimensioned for sliding insertion free-end first through the head passageway for pawl and ratchet engagement of the strap teeth with the tang to thereby provide an adjustable locked loop of variable length. In another form the retainer is a two-part assembly with a body of generally "S" or "Z" shape strip made of rigid metal or plastic. The retainer strip has an end portion formed into a hook. The strap is an elastomeric endless loop having a portion captured within the hook of the strip. The strip also is configured to define the prong and tang portions. The retainer may also be employed as an article support for quick removable attachment in a selected aperture of an apertured panel and adapted to releasably hold an article on such panel.

10 Claims, 2 Drawing Sheets

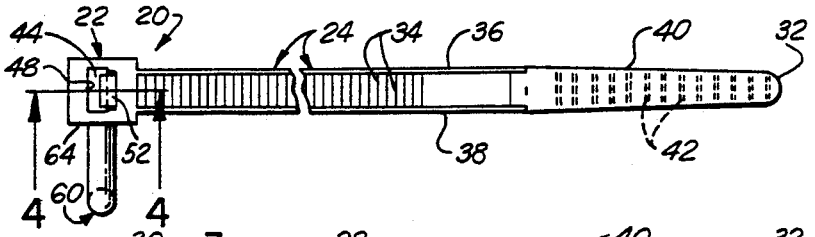
FIG.1
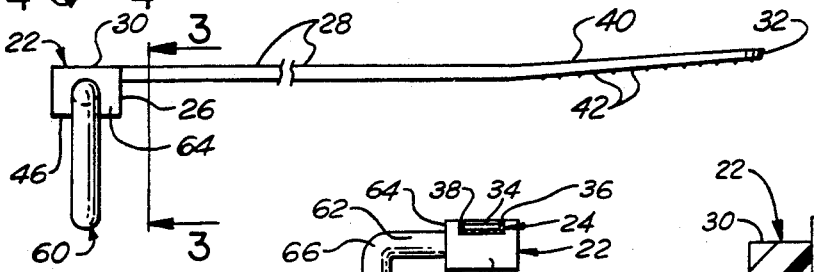
FIG.2
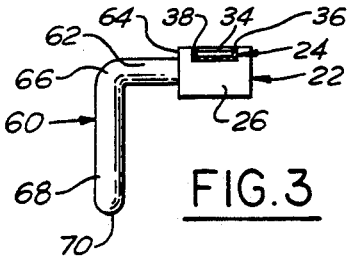
FIG.3
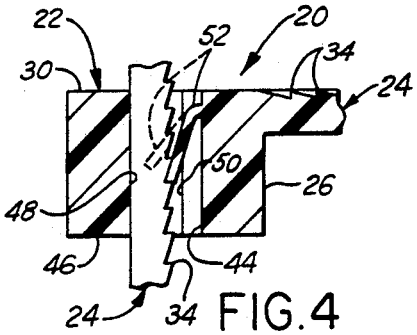
FIG.4
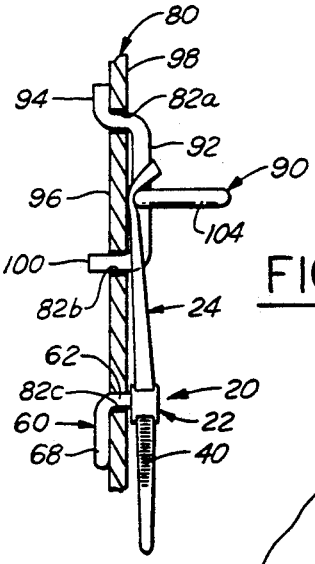
FIG.6
FIG.5
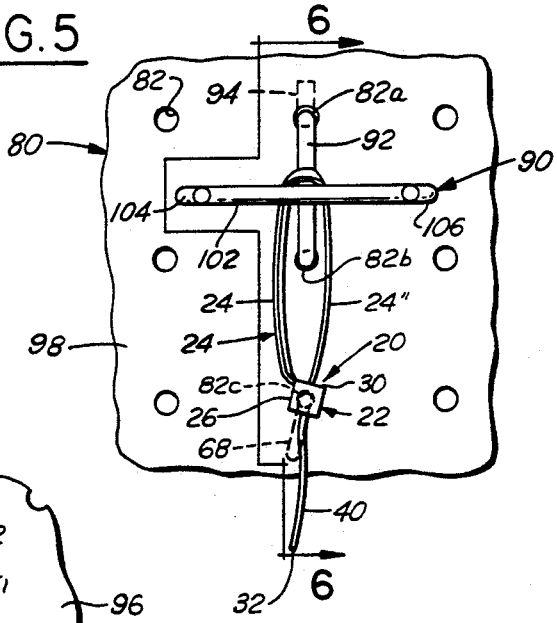
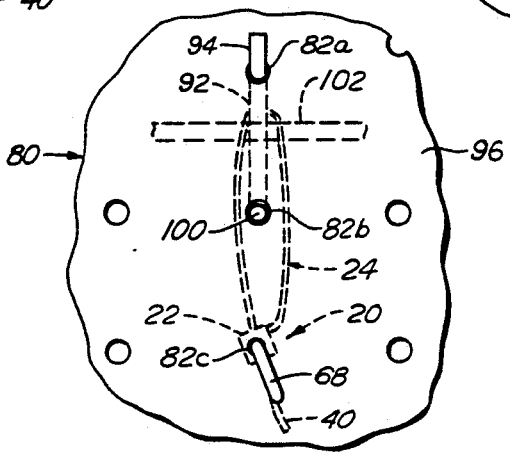
FIG.7

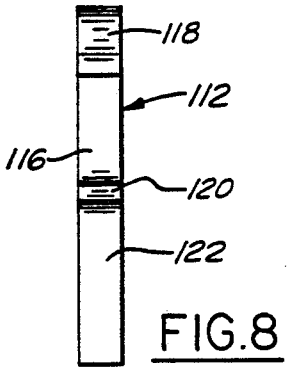
FIG.8
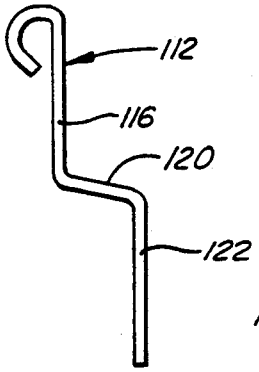
FIG.9
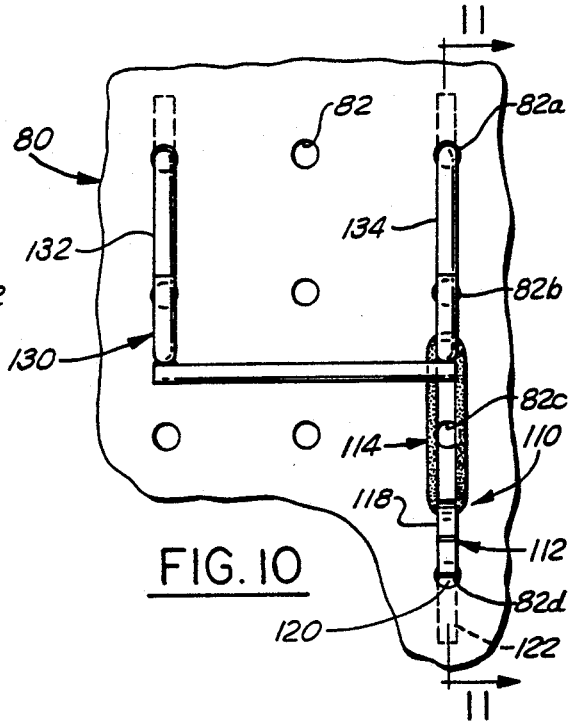
FIG. 10
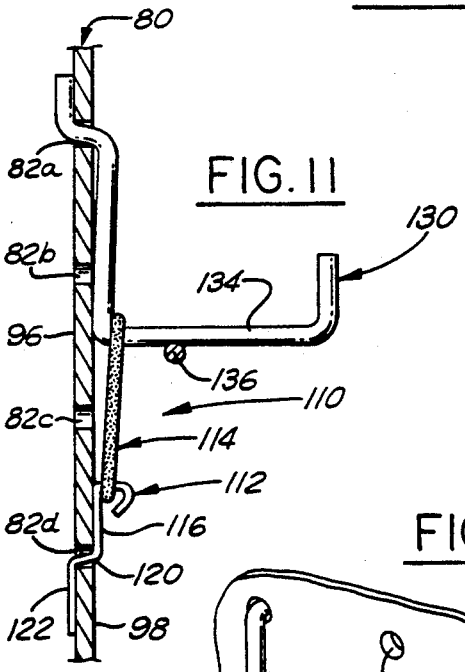
FIG. 11
FIG. 12
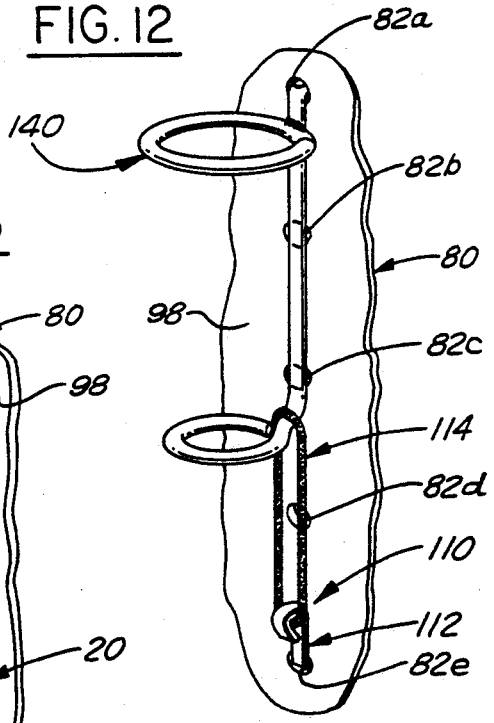
FIG. 13
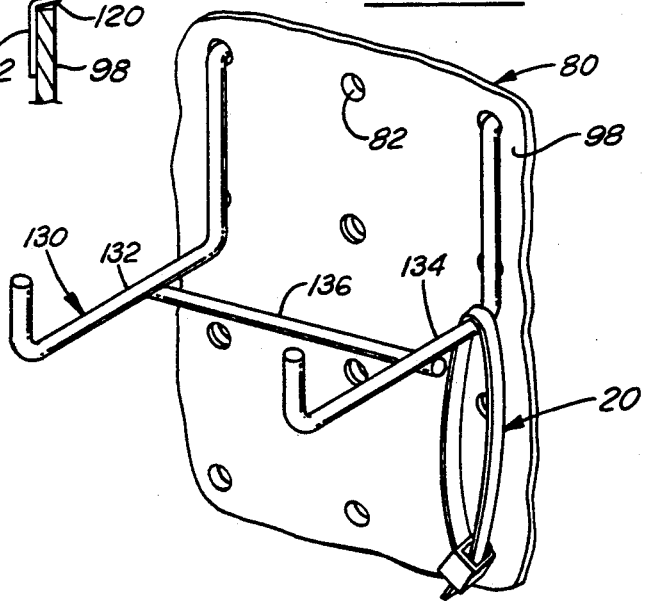

PEG BOARD HANGERS AND RETAINERS

FIELD OF THE INVENTION

This invention relates to support members of the type adapted to be detachably hooked onto multi-aperture panels, such as panels having rows and columns of equally spaced holes, commonly known as "peg boards", "perforated panels" or "perf boards", such as those sold under the registered trademark "PEG-BOARD" by Masonite Corporation of Chicago, Illinois. The invention is more particularly directed to the stabilizing of peg board hangers or hooks on the peg board.

BACKGROUND OF THE INVENTION

Article supporting racks are commonly provided by the use of relatively rigid sheets of hard board or the like perforated in a regular grid-like pattern so that supporting hangers in the form of hooks or brackets may be removably secured in various locations on the board by engaging an anchoring element of the hanger with a selected perforation in the board. Hangers for such use with peg board take many different forms and shapes that are determined primarily by the nature of the articles to be supported. In a broad sense all or most of such hangers embody in use a vertically extending body with an article-support extending forwardly from the lower end of the body or from some intermediate point spaced downwardly from the upper end of the body. At the upper end of the body anchoring means in the form of an anchoring hook is provided which may be inserted rearwardly through a selected perforation in the board in a known and well understood manner.

When thus mounted on a peg board, the body extends downwardly with respect to its interlocked or anchored upper end, and because the lower portions of the body bear against the forward face of the board, the projecting support may serve to carry the weight of an article placed on such support.

Hangers of the aforesaid character are usually made from a single length of wire having a diameter just slightly less than the diameter of the perforations in the peg board, and the anchoring means is formed by bending of the wire at one end, the support is formed by bending the wire to a hook-like or other suitable form at the other end of the wire, while an intermediate portion of the wire is left in straight form to provide the body of the hanger. Conventionally this intermediate or body portion of the hanger has a length somewhat greater than the vertical spacing of the perforations.

In the use of hangers made from a single piece of wire as above described it has been found that when an article is put in place on or is removed from the hanger, the lower end of the hanger often shifts laterally across the forward face of the board and/or outwardly or forwardly away from the board. Such forward displacement of the lower portion of the hanger often disengages the hanger from the peg board. Such undesired displacement of the hangers has been considered objectionable to such an extent that various forms of stabilizers have been provided for connecting the lower portion of the body with the perforation in which the upper end of the hanger is secured

DESCRIPTION OF THE PRIOR ART

In some instances the prior art stabilizing means has taken the form of a projecting lug integral with the body of the hanger and adapted to extend into the lower perforation with a snug friction fit. In other instances separately formed generally U-shaped fine wire clips have been provided to embrace the body of the hanger with the ends of the clips projected through the lower opening in the board and having a spring-like lateral engagement with the sides and rear cages of the perforation. Both types of conventional stabilizers have been considered to be objectionable in that when forward forces are applied to the support or hook, the stabilizer is disengaged from the lower perforation, and the user must thereupon re-engage the stabilizer with the board.

Examples of the long history of such prior art efforts to solve the peg board hook stabilization problem are to be found in the following United States patents:

| U.S. Pat. No. | Inventor |
|---|---|
| 2,790,616 | Cardinal, Jr. |
| 2,859,008 | Zimmer |
| 2,957,671 | Messier |
| 2,961,724 | Alling |
| 2,987,286 | Alling |
| 3,037,732 | Roman |
| 3,069,122 | Babajoff |
| 3,091,423 | Butterworth |
| 3,193,225 | Terlinde |
| 3,227,412 | Terlinde |
| 3,241,799 | Terlinde |
| 3,272,468 | Wittrock |
| 3,319,917 | Bilodeau |
| 3,379,919 | Hochman |
| 3,381,172 | Einhorn |
| 3,392,949 | Meyer, Jr. |
| 3,625,464 | Conran |
| 3,650,502 | Langhi |
| 4,105,179 | Elliott |
| 4,303,217 | Garfinkle |
| 4,304,382 | Jelen |
| 4,441,680 | Rivkin et al |
| 4,531,697 | Steiner et al |
| 4,645,154 | Bly |

OBJECTS OF THE INVENTION

The present invention is concerned with stabilization of peg board hangers through the use of separately formed stabilizing means, and the primary object of the invention is to provide such a separately formed stabilizer by means of which the lower body portion of the hanger may be positively held against forward and/or lateral displacement with respect to the board.

Objects related to the foregoing are to provide such a stabilizer that may be readily and easily put in place in or removed from its operative relation; to provide such a stabilizer that may be made economically by conventional plastic injection molding or wire forming equipment; and to provide such a device that is adapted for use with most or all of the conventional peg board hangers.

Further objects are to provide such a stabilizer which is adjustable in length to accommodate any number of different types of peg board hangers; which may be made in a re-useable and adjustable form if desired or which may be made inexpensively enough to be destroyed and discarded after one use; which is convertible for use as a peg board hanger in and of itself with respect to certain types of articles; which may be permanently or removably attached to an article to be carried on the article at all times and yet capable of serving as a peg board hanger for the article; and which may be positioned advantageously on the peg board at various locations relative to an associated peg board hanger to best resist the normal strain imposed on the peg board hanger during removal of the particular tool or other object for which the hanger is designed.

DESCRIPTION OF DRAWINGS

Other objects, features and advantages of the present invention will become apparent from the following detailed description, appended claims and in the accompanying drawings, wherein:

FIG 1 is a fragmentary top plan view of a first, and presently preferred, embodiment of the present invention illustrated by itself.

FIG. 2 is a fragmentary side elevational view of the embodiment of FIG. 1.

FIG. 3 is a part elevational end view and part sectional view taken along line 3—3 of FIG. 2.

FIG. 4 is an enlarged fragmentary cross-sectional view taken along line 4—4 of FIG. 1 and illustrating the tail strap of the retainer inserted through the head passageway and locked against retrograde movement by the spring locking pawl of the retainer.

FIG. 5 is a fragmentary elevational view of a perforated peg board with a conventional peg board hook removably mounted thereon but reliably secured thereto against removal by the first embodiment of the peg board retainer of the invention.

FIG. 6 is a fragmentary cross-sectional view taken along line 6—6 of FIG. 5.

FIG. 7 is a fragmentary elevational view of the peg board hook and associated retainer of the invention of FIG. 5 as viewed from the rear side of the peg board.

FIG. 8 is a side elevational view of the hook part of a two-part second embodiment of a peg board hook retainer of the invention.

FIG. 9 is a side elevational view of the hook part of the second embodiment shown in FIG. 8.

FIG. 10 is a fragmentary front elevational view of a portion of the peg board with another type of conventional peg board hook mounted thereon and releasably and reliably secured thereto by the two-part second embodiment of the peg board retainer of the invention.

FIG. 11 is a fragmentary cross-sectional view taken along line 11—11 of FIG. 10.

FIG. 12 is a fragmentary perspective view of the front side of a perforated peg board with another type of conventional peg board hook or holder mounted thereon and reliably and releasably secured thereto by the second embodiment retainer of the invention.

FIG. 13 is a fragmentary perspective view of the front portion of the perforated peg board with the conventional peg board hook of FIGS. 10 and 11 removably mounted thereon but reliably secured thereto by the first embodiment retainer of the present invention.

DETAILED DESCRIPTION

First Embodiment

Referring to the drawings in more detail, wherein like numerals are used to designate similar parts throughout the several views, FIGS. 114 4 illustrate a first embodiment of a peg board hook retainer and hanger 20 of the present invention. Preferably the retainer 20 is a one-piece part adaptable for mass production by injection molding from a suitable plastic material such as nylon, and preferably is made as an adaptation of commercially available "wire ties" which are conventionally used to secure wire bundles, cables and harnesses. Various standard and modified wire ties such as those commercially available from Great Value Industries, Inc. of 118 Summit Drive, Exton, Penna. may serve as an example. These are constructed in a one-piece design from fungus-inert, self-extinguishing 6/6 nylon which remains continuously servicable over a temperature range of −40° F. to +145° F. and are supplied in natural white or in colors such as orange, and also may be obtained in an ultra-violet resistant black modification. Such wire ties are well developed in the art and various forms of the same as shown in the following United States patents:

| U.S. Pat. No. | Inventor |
|---|---|
| 2,915,268 | Wrobel |
| 2,969,216 | Hallsey |
| 3,147,523 | Logan |
| 3,214,808 | Litwin |
| 3,302,913 | Collyer et al |
| 3,463,427 | Fisher |
| 3,484,905 | Eberhardt |
| 3,552,696 | Orenick et al |
| 4,183,119 | Stewart et al |
| 4,236,280 | Kreiseder |
| 4,490,886 | Omata |
| 4,705,245 | Osada |
| 4,735,387 | Hirano et al |
| 4,766,651 | Kobayashi et al |

Retainer 20 thus has a head 22 which may be generally in the form of six-sided rectangular block, and a tail-like strap 24 integrally joined near the upper edge of one end face 26 of block 24 and extending therefrom with its upper side 28 flush with the top face 30 of block 24 and terminating in a curved free end 32. For most of its length, strap 24 is provided on its upper face with transversely extending locking teeth 34 which are recessed slightly below the raised side edges 36 and 38 which, in wire tie use, are adapted to contact the bundle of elongated wires, tubes or other members secured in bound relationship by the wire tie. Strap 24 has a slightly tapered leader portion 40 with transverse raised ribs 42 on its under side which facilitate finger gripping of the free end of the strap in use.

Head 22 has a through-opening 44 which extends from the top face 30 to the bottom face 46 of the head (FIG. 4) with its longitudinal axis perpendicular to that of strap 24. Opening 44 is made rectangular in cross-sectional configuration and has a width slightly larger than that of strap 24 and a dimension between its front and rear walls 48 and 50 slightly less than twice that of strap 24. A resilient locking tang 52 is integrally formed in a recessed slot in opening 44 and in its free state condition occupies the position shown in phantom in FIG. 4. Tang 52 is yieldably deflected by inserting the strap 24 into opening 44 (downwardly as viewed in FIG. 4) with teeth 34 facing tang 52. This permits strap 24 to be slid past tang 52 as the tang yieldably ratchets over teeth 34. When pull-through force is released from strap 24, tang 52 springs out to the solid line position shown in FIG. 4 wherein tang 52 engages a selected tooth 34 to serve as a pawl to lock strap 24 against retrograde or withdrawal motion in opening 44 (upwardly as viewed in FIG. 4).

In accordance with one principal feature of the present invention, retainer 20 is provided with an L-shaped hook 60 integrally joined to head 22 for removably securing retainer 20 to a perforated board of the peg board type. Hook 60 has an arm portion 62 integrally joined at one end to head 22 so as to protrude generally centrally of one of the side faces 64 of head 22 with its axis perpendicular to the longitudinal axis of strap 24 and perpendicular to the longitudinal axis of the through opening 44. Arm 62 is joined by a right angle bend 66 to a finger or tang portion 68 of hook 60. In the illustrated embodiment, tang 68 extends with its longitudinal axis perpendicular to strap 24 and parallel to opening 44. The free end 70 of tang 68 is preferably rounded, and hook 60 is preferably cylindrical in cross section and of constant diameter, slightly less than the diameter of the peg board perforations on which retainer 20 is to be used. Hook 60 is preferably injection molded integrally with the remaining structure of retainer 20 and thus is also made of the same plastic material, such as nylon. The distance between head face 64 and tang 68 is preferably slightly greater than the thickness of the perforated board on which the retainer 20 is to be used, and the axial length of tang 68 is generally slightly less than half the distance of the hole spacing in the peg board.

The manner of use and operation of retainer 20 is best seen in conjunction with FIGS. 5, 6 and 7 wherein a portion of a standard perforated board, commonly known as "peg board", is illustrated at 80. Such peg boards are well known and usually consist of a flat board with a plurality of holes 82 therein. Holes 82 form a grid work on the board and are regularly spaced at uniform intervals. Usually but not essentially there is a lateral distance of one inch between centers of horizontally adjacent holes 82 and likewise a vertical distance of one inch between centers of vertically adjacent holes 82. Peg boards are usually made in nominal ⅛ inch and ¼ inch thicknesses for light and heavy-duty applications, respectively. One-eighth inch peg boards typically employ peg board hooks made of mild steel wire having a diameter of ⅛ inch, and the diameter of the associated holes 82 in such board is usually slightly oversize, such as 5/32 inch. One-fourth inch peg boards employ hooks with a wire diameter of 3/16 inches, and holes 82 are made slightly oversize, say 7/32 inch, to accommodate the larger diameter hooks.

In FIGS. 5, 6 and 7, to facilitate description, a vertical row of three respectively adjacent holes 82 is designated from top to bottom, 82*a*, 82*b* and 82*c*. One standard type of peg board hanger 90 is shown removably mounted on board 80, hanger 90 being of the type commonly provided for supporting a pair of pliers on the board. Hanger 90 has the usual body 92 joined at its upper end to the L-shaped hook portion 94 which is inserted through hole 82*a* and extends upwardly a short distance adjacent the back face 96 of board 80. Body portion 92 extends downwardly adjacent the front face 98 of board 80 and is joined through a right angle bend at its lower end to a tang portion 100 which extends rearwardly perpendicular to the plane of the board through the next lower hole 82*b*. Hanger 90 has a cross arm 102 extending horizontally perpendicular to body portion 92 and is welded thereto. Cross arms 102 terminates at its opposite ends in a pair of arms 104 and 106 which are slightly curved to embrace the associated arms of a pair of pliers therebetween to support the pliers in hanging relationship on hanger 90.

Hanger 90 is inserted on board 80 by holding the same tilted away from the front face 98 of the board while the upper hook portion 94 is inserted through hole 82*a*. Then the hanger is tilted down to bring tang 100 through hole 82*b*. A pair of pliers may then be hung on hanger 90 by sliding the same nose first downwardly between the arms 104, 106 until the arms of the pliers rest on the cross arm 90. When removing the pliers, the same may stick to or snag on arms 104, 106 so that an upward pull is exerted on hanger 90 which may also have an outward component away from the face 98 of the board. This will tend to pivot hanger 90 to remove tang 100 from its associated hole 82*b*, thereby loosening hanger 90 and possibly causing the same to become detached from the board.

In accordance with the present invention, such undesirable displacement of the peg board hanger during tool removal is prevented by employing the peg board hook retainer 20 of the present invention as shown in FIGS. 5, 6 and 7. This is readily accomplished by inserting the hook 60 of retainer 20 through the next subjacent hole 82*c* of the board with the retainer in its open or unlatched condition as shown in FIGS. 1 and 2. Strap 24 is then trained upwardly behind the left-hand portion (as viewed in FIG. 5) of cross arm 102, thence outwardly and across hook body 92, and thence downwardly behind the right-hand portion of cross arm 102. The free end 32 of strap 24 is then fed through the head opening 44 so that the finger gripping portion 40 can be grasped between the fingers of the user and pulled taut. This draws the left and right hand runs 24' and 24'' of strap 24 towards one another generally to the positions thereof illustrated in FIG. 5. Upon release of the finger tension from portion 40, tang 52 will lock strap 24 in the adjusted position to thereby secure both retainer 20 and hook 90 permanently onto board 80.

It is to be noted that in this fully fastened position, head 22 when applied in the manner in FIGS. 5–7 will be tilted so that its upper face 30 extends at an angle of about 20 degrees to the horizontal. Accordingly the tang 68 of hook 60 is likewise inclined at the same angle of 20 degrees from vertical. This inclination is a product of the resultant forces exerted by the strap runs 24 and 24' and their attachment orientation to head 22. This inclination angle will vary depending upon hole 82*c* selected for fastening retainer 20 to board 80, and upon the form of the associated peg board hook. However, it has been found that the inclination of tang 68 generally will not exceed more than an approximately 45 degree tilt from vertical. If desired, tang 68 may be made with a pre-orientation angle in anticipation of the tilting action of head 22 such that tang 68, when retainer 20 is securely tightened and fastened, extends within a narrow angular range including vertically downwardly as it bears against the rear face 96 of the peg board. In the illustrated application of FIGS. 5–7, such pre-orientation angulation of tang 68 thus would orient tang 68 with its axis inclined 20 degrees from the longitudinal axis of head passage 44 in a direction away from head face 26.

However, for most applications it has been found satisfactory to orient tang 68 so that it extends parallel to the axis of opening 44 and hence generally in the direction of the free end of strap 24 protruding beyond head 22 in the latched condition thereof. Inasmuch as the tang 52 employed in retainer 20 is of the permanent latching type, if it is desired to remove retainer 20 from securing relationship with peg board hook 90, it is necessary to cut the strap 24, and then remove retainer 20 from the board and discard the same. However, due to the inexpensive nature of retainer 20, such one time use of the same represents an insignificant cost to the average peg board user.

Nevertheless, retainer 20 may be modified in accordance with the present invention to be re-useable merely by constructing the tie portion of the retainer in accordance with the Kreiseder U.S. Pat. No. 4,236,280, issued Dec. 2, 1988, which is incorporated herein by reference. This modified wire tie (not shown) is similar to that described with respect to embodiment 20 except that it is provided with an accessible release latch integrally formed with the body or head 22 to permit release of the tang of the latch from pawl engagement with the cooperating teeth on the strap. This permits the strap to be withdrawn from the head to permit removal of the retainer from the peg board for re-use with another peg board hook as desired. Such a releasable latch arrangement also permits re-adjustment as desired of the retainer. The integral hook portion 60 is attached to the modified releasable retainer head in the same manner as described above in conjunction with the retainer 20. The modified releasable retainer is also attached to the peg board and associated peg board hook in the same manner as described above.

It has been found that the retainer 20 of the present invention will tightly retain peg board hook 90 in the mounted position shown in FIGS. 5, 6 and 7, despite exertion of excessive force in any direction therein, such as when attempting to free a tool jammed on hook 90. For example, when an upward and outward force is exerted on hook 90 as described previously, this force will be resisted by strap 24 exerting a pull force on head 22 which in turn is resisted by hook 60, the resultant force tending to force tang portion 68 more tightly against the back face 96 of the peg board. Hence, hook 90 can not be pivoted laterally or outwardly away from the front face 98 of the peg board due to the restraint exerted by retainer 20.

Second Embodiment

Referring to FIGS. 8–12, a second embodiment of a peg board retainer of the present invention is illustrated in the form of a two-part retainer 110 (FIGS. 10, 11 and 12). Retainer 110 comprises a first unitary part in the form of a metal hook 112 and a second unitary part consisting of a cooperative elastomeric endless band 114 preferably in the form of a rubber O-ring or a specially designed rubber band. Hook 112 is shown by itself in FIGS. 8 and 9 comprises a flat strip of sheet metal, preferably stamped from mild steel into an "S" or "Z" shape. Hook 112 thus has a straight body portion 116, the upper free end of which is a return bent to form a hook portion 118. The center of hook 112 is bent at slightly less than a right angle to form a slanted bite portion 120 which slopes downwardly to lower leg 122 extending parallel to body 116. When designed for use with a bend junction with a vertical ⅛ inch thickness (nominal) peg board, hook 112 has a width dimension of about 0.125 inches and is preferably made with a thickness dimension of 0.050 inches. When bending the material to form hook 112 to make the hook eye 118 the space between the free end 124 of hook and the juxtaposed surface of body 116 is made slightly less than the thickness of the O-ring 114. The O-ring 114 for most applications involving peg board hooks for ⅛ inch peg boards may be a commercially available O-ring having a nominal overall loop diameter of ¾ inch in its free state condition.

To assemble the two-part retainer 110, O-ring 114 is merely slipped past the gap between hook end 124 and body 116, being slightly squeezed to pass therethrough so as to then be captured in the eye of the hook. This is done at the point of manufacture so that the product may be packaged and sold as a unitary two-piece assembly so that the user need not assemble the retainer before putting it to use.

In the use and operation of the modified retainer 110 of the present invention, the same, like retainer 20, is adaptable for use with any type of standard peg board hook. To further illustrate this feature, in FIGS. 10 and 11 retainer 110 is shown as a restraint for a standard peg board hook 130 (also illustrated in FIG. 13) of the type having two spaced cradle arms 132 and 134 connected by a cross strut 136 welded to the under side of these arms. This will be readily recognized as a hammer-support peg board hook and is typically designed to be inserted into two horizontally spaced holes 82 of a peg board spaced 2 inches apart so as to leave a vacant hole 82 therebetween. As illustrated in FIGS. 10 and 11, in order to restrain this type of peg board hook 130 from inadvertent detachment from the peg board 80, retainer 110 is assembled to peg board 130 by slipping O-ring 114 over the upper end of one of the legs 134 and then dropped downwardly so that the upper end of the O-ring 114 remains trained over the horizontal branch of leg 134. Hook 130 is then assembled to board 80 in the usual manner by inserting its upper end prongs into the spaced holes 82 as shown in FIGS. 10 and 11. Retainer 110 is then secured to peg board 80 by inserting the tang 122 of hook 112 through a peg board hole **82*d* aligned vertically beneath arm 134 and suitably spaced downwardly from hook 130 so as to place O-ring 114 under suitable stretched tension. As illustrated, hole 82*d* is the fourth in a series of vertically aligned holes 82*a*–82*d* for this particular installation. Typically O-ring 114 is stretched to twice its free state length in order to develop sufficient clamping stress on the associated peg board hook. The tension exerted by the resilient O-ring 114 will securely force the vertical portion of the associated leg 134 tightly against the outer face 98 of peg board 80, while at the same time placing hook 112 under a shear force which tightly holds tang 122 against the board rear face 96 and body portion 116 tightly against the board front face 98. Accordingly, any force tending to pivot hook 130 laterally and/or away from the front board face 98 merely increases the clamping tension exerted by retainer 110 to thereby increasingly resist any such movement. Retainer 110 thus, like retainer 20, is operable to reliably prevent hook 130 from being inadvertently separated or dislodged from board 80**.

When it is desired to remove hook 130 from board 80 to relocate the same or to replace it with a different style hook, retainer 110 may be removed from the board by grasping hook portion 118 with pliers and exerting sufficient force to pivot the same outwardly and downwardly so that tang 120 can be retracted from the associated peg board hole **82*d* to thereby release retainer 112 from the board. Hook 130 then may be removed from the board in the usual manner with retainer 110** dangling freely therefrom.

FIG. 12 illustrates the use of retainer 110 in conjunction with another standard type peg board hook 140 which will be recognized as a screw driver holder having a main body portion with two spaced rings attached thereto, the upper ring being of larger diameter than the lower ring. The application of retainer 110 to hook 140 will be readily apparent from the illustration of FIG. 12 in conjunction with the foregoing description.

FIG. 13 illustrates how the first embodiment retainer 20 is utilized with the hammer peg board hook 130 the same being trained over arm 134 and used in place of retainer 110.

Further Advantages

From the foregoing description it will not be apparent that the embodiments of the invention described and illustrated herein readily fulfill the aforestated objects of the invention. In addition, by comparison to the afore-mentioned prior art devices directed to the solution of the same problem, the peg board hook retainer of the present invention represents the ultimate in simplicity and universality in use. Retainers 20 and 110 are readily adapted to mass production machinery and processes so as to be made at minimal cost. Due to the concept of the retainer of the invention comprising a hook insertable in a selected peg board hole and having an associated adjustable strap connected thereto, whether the same be adjustable in length by strap take-up and tensioning as in retainer 20 or resilient and stretchable to adjust its length as in retainer 112, either embodiment is adaptable to substantially all standard peg board hooks in current use. Hence, absolutely no modification need be made to these standard peg board hooks in order to securely retain them either permanently or in releasable fashion to an associated peg board.

A further advantage of the peg board hook retainers of the invention is that they are useful in and of themselves as special peg board hooks. Because the retainers come equipped with an adjustable or variable length strap, the strap may be employed to encircle the shank of various types of tools, such as a hammer or screwdriver, and the retainer left attached, if desired, to the tool during use of the tool. When it is desired to hang the tool on a peg board, the retainer is used in the form of a peg board hook by inserting its associated hook tang through a selected peg board hole and the tool hung therefrom. In this event the tang extends upwardly against the back face of the board rather than downwardly as in its use as a peg board hook retainer. Retainer 20 is particularly well adapted for this dual use inasmuch as the strap 24 can be made extra long so that it can encircle large diameter portions of objects or tools to be hung from a peg board; for example, a coiled garden hose, bamboo garden rakes, etc. Strap 24 can be pulled very taut about the object and left permanent locked thereto so that it will not come loose, nor is it in the way when using the tool. Of course, a second retainer 20 or 110 then may be used to securely retain the tool to the board while hanging from the first retainer.

It also has been found that the peg board hook retainers of the invention, due to the placement of the hook portion of the retainer primarily in shear stress, provide a very secure attachment both of themselves and the associated retained peg board hook to the peg board, and such secure retention is accomplished with a minimum of structure since the retainer of the invention is believed to represent the ultimate in simplicity of form and function. It is also to be understood that prong 60 of retainer 20 or prong 122 of retainer 110 can be modified to extend upwardly rather downwardly against board back face 96, but the illustrated downward orientation is preferred for ease of insertion through the associated peg board hole.

While the invention has been disclosed and described with reference to a limited number of embodiments, it will be apparent that many variations and modifications may be made therein by those skilled in the art based upon the instant disclosure. It is therefore intended that such variations and modifications shall fall within the spirit and scope of the present invention as set forth in the appended claims and is limited only by the applicable prior art.

I claim:

1. A retainer for holding an associated article support peg board hook against a peg board having holes therein such that the peg board hook is mounted to lie against a first surface defining one side of the peg board by pivotal engagement with such board via an associated peg board hole so as to be pivotably supported on such board, said retainer comprising:

a variable length strap including a loop-forming portion for at least partially surrounding a portion of an associated peg board hook in board-restraining relation thereto with the associated peg board hook mounted on said board against said first surface thereof; and a one-piece peg board attachment hook means operably connected to said strap, said attachment hook means including prong means removably insertable from said first surface of said one side of said board through a selected hole of said peg board in the subjacent vicinity of the hole or holes to which the associated peg board hook is mounted, said spring means having an arm or bite portion with a longitudinal axis extending in the board-mounted condition of said retainer generally perpendicularly to said first surface of said board, said prong means also having an elongate tang or leg portion with a longitudinal axis oriented generally perpendicularly to said longitudinal axis of said arm or bit portion or said prong means for engaging along the length of said tang or leg portion a second surface defining a second side of said peg board opposite from and extending parallel to said first surface of said one side of said board against which the associated peg board hook lies, such that any force tending to pivot the associated peg board hook increases the clamping tension exerted by said strap thus increasingly resisting any movement of said hook, said strap being tensionable for increasing the grip of said retainer on the shank of the associated peg board hook to be retained to thereby retain the associated peg board hook on the board despite pivotal dislodgment forces being exerted on such peg board hook, said attachment means comprising a head having a through-passageway with a resilient locking means operably disposed therein, and said variable length strap comprising a long, narrow flexible member affixed at one end to said head to extend lengthwise therefrom clear of said passageway, the other end of said strap being free, said strap having teeth formed thereon and being dimensioned for sliding insertion through said passageway for pawl and ratchet engagement of said strap teeth with said locking means to thereby provide an adjustable loop of variable length to thereby serve as said loop-forming portion of said strap.

2. The retainer as set forth in claim 1 wherein said tang or leg portion of said prong means extends in a direction generally parallel to the axis of said passageway and perpendicular to the longitudinal axis of said one end of said strap.

3. The retainer as set forth in claim 1 wherein said prong means arm or bite portion is fixedly joined to said head and extends therefrom in a direction generally perpendicular to the longitudinal axes of said strap and said passageway.

4. The retainer as set forth in claim 3 wherein said tang or leg portion of said prong means extends from said arm portion in a direction generally parallel to the axis of said passageway.

5. The retainer as set forth in claim 4 wherein said variable length strap and said attachment hook means are molded in one-piece from plastic material, said strap being dimensioned and constructed to be flexible and said prong means being dimensioned and constructed to be rigid.

6. A retainer as set forth in claim 5 wherein said head of said attachment means comprises four side faces and first and second opposed end faces with the through-passageway extending from said first end face to said second end face.

7. A retainer as set forth in claim 6 wherein said prong means comprises a rod-like member extending generally centrally from one of said side faces.

8. A retainer as set forth in claim 7 wherein said prong means has a substantially constant diameter slightly less than the diameter of the peg board holes.

9. A retainer as set forth in claim 8 wherein said side and end faces are oriented such that said head of said attachment means is rectangular.

10. The combination of a peg board having holes therein, a peg board hook engaged with said board via one or more of said peg board holes so as to be pivotably supported thereon, and a retainer operably coupled with said peg board hook for restraining said hook against pivotal movement on said peg board and wherein said peg board, said peg board hook and said retainer are constructed and arranged as set forth in claims 1, 3, 4, 2, 5, 6, 7, 8 or 9.

* * * * *

UNITED STATES PATENT AND TRADEMARK OFFICE

CERTIFICATE OF CORRECTION

PATENT NO. : 5,112,014

DATED : May 12, 1992

INVENTOR(S) : Byron Nichols

It is certified that error appears in the above-indentified patent and that said Letters Patent is hereby corrected as shown below:

Claim 1 at column 10, line 28, "spring" should be --prong.

Claim 1 at column 10, line 35, "bit" should be --bite--.

Signed and Sealed this

Twentieth Day of July, 1993

*Attest:*

Michael K. Kirk

MICHAEL K. KIRK

*Attesting Officer*

*Acting Commissioner of Patents and Trademarks*